US010165797B2

(12) United States Patent
Chen et al.

(10) Patent No.: US 10,165,797 B2
(45) Date of Patent: Jan. 1, 2019

(54) CIGARETTE DISTILLATION AND ATOMIZATION DEVICE

(71) Applicant: Smiss Technology Co., Ltd., Shenzhen (CN)

(72) Inventors: Jiatai Chen, Shenzhen (CN); Shikai Chen, Shenzhen (CN)

(73) Assignee: SMISS TECHNOLOGY CO., LTD., Shenzhen (CN)

( * ) Notice: Subject to any disclaimer, the term of this patent is extended or adjusted under 35 U.S.C. 154(b) by 398 days.

(21) Appl. No.: 14/997,092

(22) Filed: Jan. 15, 2016

(65) Prior Publication Data

US 2017/0006918 A1 Jan. 12, 2017

(30) Foreign Application Priority Data

Jul. 7, 2015 (CN) ..... 2015 1 0394116

(51) Int. Cl.
*A24F 47/00* (2006.01)
*H05B 1/02* (2006.01)

(52) U.S. Cl.
CPC ..... *A24F 47/008* (2013.01); *A24F 47/004* (2013.01); *H05B 1/0244* (2013.01)

(58) Field of Classification Search
CPC ..... A24F 47/008; A24F 47/004; H05B 1/00
USPC ..... 131/194, 328, 329; 392/397, 404; 219/534
See application file for complete search history.

(56) References Cited

U.S. PATENT DOCUMENTS 2,191,672 A * 2/1940 Malicki ..... A24F 13/10 131/182
2,216,920 A * 10/1940 Lykos ..... A24F 13/14 131/175

(Continued)

FOREIGN PATENT DOCUMENTS

CN 2115659 9/1992
CN 101557728 10/2009

(Continued)

OTHER PUBLICATIONS

Chen et al., "Variation of volatile acids contents in flue-cured tobacco leaves and the relationship with neutral aroma matters", Journal of Zhengzhou University of Light Industry (Natural Science), vol. 25, No. 5, Oct. 2010, 5 pages.

(Continued)

*Primary Examiner* — Jimmy Chou
(74) *Attorney, Agent, or Firm* — Hamre, Schumann, Mueller & Larson, P.C.

(57) ABSTRACT

A cigarette distillation and atomization device, including: a support, an air inlet, and an air outlet, where the air inlet and the air outlet are provided on the support; a first heating system and a second heating system are provided in the support; a cigarette accommodating area is provided in the second heating system; the first heating system and the second heating system are hermetically connected; air entering the air inlet is heated by the first heating system to form a hot air flow, and the hot air flow enters the second heating system; and the hot air flow and the second heating system simultaneously heat a cigarette placed in the cigarette accommodating area to form smoke, and the smoke goes out from the air outlet.

11 Claims, 7 Drawing Sheets

(56) References Cited

U.S. PATENT DOCUMENTS 4,503,319 A * 3/1985 Moritoki ..... B22F 3/15 219/390
4,622,454 A * 11/1986 Castille ..... B60N 3/14 16/433
5,285,050 A * 2/1994 Blackburn ..... F23Q 7/16 219/240
5,388,594 A * 2/1995 Counts ..... A24F 47/008 128/202.21
5,692,526 A * 12/1997 Adams ..... A24F 47/008 131/194
5,726,421 A * 3/1998 Fleischhauer ..... A24F 47/008 131/182
5,878,752 A * 3/1999 Adams ..... A24F 47/008 131/194
5,934,289 A * 8/1999 Watkins ..... A24F 47/008 128/202.21
5,954,979 A * 9/1999 Counts ..... A24F 47/008 131/194
6,188,042 B1 * 2/2001 Sheen ..... B60N 3/14 219/266
6,598,607 B2 * 7/2003 Adiga ..... A24F 47/004 131/194
8,714,161 B2 * 5/2014 Liu ..... A24F 47/008 128/202.21
8,857,446 B2 * 10/2014 Wu ..... A24F 47/008 128/202.21
9,848,644 B2 * 12/2017 Plunkett ..... A24F 47/008
9,930,915 B2 * 4/2018 Worm ..... A24F 47/008
2002/0005207 A1 * 1/2002 Wrenn ..... A24C 5/478 131/194
2003/0209531 A1 * 11/2003 Mattis ..... B60N 3/14 219/265
2003/0226837 A1 * 12/2003 Blake ..... A24F 47/008 219/260
2004/0089314 A1 * 5/2004 Felter ..... A24F 47/008 131/194
2004/0129280 A1 * 7/2004 Woodson ..... A24B 15/282 131/194
2004/0149296 A1 * 8/2004 Rostami ..... A24F 47/008 131/194
2004/0200488 A1 * 10/2004 Felter ..... A24F 47/008 131/194
2006/0070633 A1 * 4/2006 Rostami ..... A24F 47/008 131/194
2009/0272379 A1 * 11/2009 Thorens ..... A24F 47/008 128/202.21
2012/0060853 A1 3/2012 Robinson et al.
2012/0111347 A1 * 5/2012 Hon ..... A24F 47/008 131/329
2012/0234821 A1 * 9/2012 Shimizu ..... A24F 13/00 219/227
2012/0260927 A1 * 10/2012 Liu ..... A24F 47/008 131/329
2012/0285475 A1 * 11/2012 Liu ..... A24F 47/008 131/329
2013/0037041 A1 * 2/2013 Worm ..... A24F 47/008 131/329
2013/0056013 A1 * 3/2013 Terry ..... A24F 47/008 131/328
2013/0081642 A1 * 4/2013 Safari ..... A24F 47/008 131/329
2013/0167853 A1 * 7/2013 Liu ..... A24F 47/008 131/329
2013/0192617 A1 * 8/2013 Thompson ..... A24F 47/008 131/329
2013/0192618 A1 * 8/2013 Li ..... A24F 47/008 131/329
2013/0213419 A1 * 8/2013 Tucker ..... A24F 47/008 131/328
2013/0319436 A1 * 12/2013 Liu ..... A24F 47/008 131/329
2013/0319438 A1 * 12/2013 Liu ..... A24F 47/008 131/329
2013/0340778 A1 * 12/2013 Liu ..... A24F 47/002 131/329
2014/0007891 A1 * 1/2014 Liu ..... A24F 47/002 131/329
2014/0014126 A1 * 1/2014 Peleg ..... A24F 47/008 131/329
2014/0048086 A1 * 2/2014 Zhanghua ..... A24F 47/008 131/329
2014/0103020 A1 * 4/2014 Al-Qaffas ..... F23Q 7/16 219/201
2014/0150810 A1 * 6/2014 Hon ..... A24F 47/008 131/329
2014/0196733 A1 * 7/2014 Liu ..... A24F 47/008 131/329
2014/0196734 A1 * 7/2014 Liu ..... A24F 47/008 131/329
2014/0216484 A1 * 8/2014 Liu ..... A24F 47/008 131/329
2014/0224244 A1 * 8/2014 Liu ..... H05B 3/14 128/202.21
2014/0230835 A1 * 8/2014 Saliman ..... A24F 47/008 131/329
2014/0238421 A1 * 8/2014 Shapiro ..... A24F 47/008 131/328
2014/0253144 A1 * 9/2014 Novak, III ..... G01R 31/327 324/550
2014/0261486 A1 * 9/2014 Potter ..... A24F 47/008 131/328
2014/0261487 A1 * 9/2014 Chapman ..... A24F 47/008 131/328
2014/0261500 A1 * 9/2014 Park ..... A24F 47/008 131/329
2014/0262856 A1 * 9/2014 Damiani ..... A24D 1/08 206/86
2014/0270729 A1 * 9/2014 DePiano ..... A24F 47/008 392/397
2014/0283857 A1 * 9/2014 Liu ..... A24F 47/008 131/329
2014/0290674 A1 * 10/2014 Liu ..... A24F 47/008 131/329
2014/0299137 A1 * 10/2014 Kieckbusch ..... A24F 47/008 131/328
2014/0311505 A1 * 10/2014 Liu ..... A24F 47/008 131/329
2014/0355969 A1 * 12/2014 Stern ..... A24F 47/008 392/390
2015/0000684 A1 * 1/2015 Wu ..... A24F 47/008 131/329
2015/0020831 A1 * 1/2015 Weigensberg ..... A24F 47/008 131/329
2015/0027461 A1 * 1/2015 Liu ..... A24F 47/008 131/329
2015/0027473 A1 * 1/2015 Graf ..... F22B 1/288 131/329
2015/0034104 A1 * 2/2015 Zhou ..... A24F 47/008 131/329
2015/0053215 A1 * 2/2015 Liu ..... A24F 47/008 131/329
2015/0053218 A1 * 2/2015 Liu ..... A61M 11/042 131/329
2015/0083147 A1 * 3/2015 Schiff ..... A24F 47/008 131/329
2015/0101626 A1 * 4/2015 Li ..... A24F 47/008 131/329
2015/0157055 A1 * 6/2015 Lord ..... A24F 47/008 131/329
2015/0173422 A1 * 6/2015 Liu ..... H05B 1/0244 131/329
2015/0181936 A1 * 7/2015 Lyubomirskiy ..... A24F 47/008 219/553
2015/0196055 A1 * 7/2015 Liu ..... A24F 47/008 131/329
2015/0196059 A1 * 7/2015 Liu ..... A24F 47/008 131/329

(56) References Cited

U.S. PATENT DOCUMENTS

2015/0201674 A1* 7/2015 Dooly ..... A24F 47/008 53/432
2015/0216232 A1* 8/2015 Bless ..... A24F 47/008 131/328
2015/0245654 A1* 9/2015 Memari ..... A24F 15/12 141/2
2015/0245658 A1* 9/2015 Worm ..... A24F 47/008 131/328
2015/0257445 A1* 9/2015 Henry, Jr. ..... A24F 47/008 131/328
2015/0272217 A1* 10/2015 Chen ..... A24F 47/008 131/329
2015/0272218 A1* 10/2015 Chen ..... H05B 3/44 131/329
2015/0282527 A1* 10/2015 Henry, Jr. ..... A24F 47/008 131/328
2015/0305408 A1* 10/2015 Liu ..... H05B 3/44 131/329
2015/0313282 A1* 11/2015 Ademe ..... A24F 47/008 131/329
2015/0313284 A1* 11/2015 Liu ..... A24F 47/008 131/329
2015/0366265 A1* 12/2015 Lansing ..... A24F 47/004 131/329
2016/0007651 A1* 1/2016 Ampolini ..... A24F 47/008 131/328
2016/0066621 A1* 3/2016 DePiano ..... A24F 47/008 131/328
2016/0089508 A1* 3/2016 Smith ..... A61M 15/06 128/200.16
2016/0095352 A1* 4/2016 Liu ..... H01M 2/34 131/329
2016/0095357 A1* 4/2016 Burton ..... A24F 47/008 131/328
2016/0113326 A1* 4/2016 Li ..... H05B 3/00 131/329
2016/0128386 A1* 5/2016 Chen ..... A24F 47/008 131/329
2016/0128389 A1* 5/2016 Lamb ..... A24F 47/008 131/328
2016/0262455 A1* 9/2016 Chen ..... A24F 47/008
2017/0042230 A1* 2/2017 Cameron ..... A24F 47/008

FOREIGN PATENT DOCUMENTS

| | | | |
|---|---|---|---|
| CN | 103181622 | | 7/2013 |
| CN | 203748662 | | 8/2014 |
| CN | 203748680 | | 8/2014 |
| CN | 203952406 | | 11/2014 |
| CN | 204132401 | | 2/2015 |
| CN | 104664608 | | 6/2015 |
| CN | 104983073 | | 10/2015 |
| CN | 204796730 | | 11/2015 |
| CN | 105361245 | | 3/2016 |
| CN | 205161888 | | 4/2016 |
| DE | 102006021848 | | 11/2007 |
| EP | 0430559 | A2 | 6/1991 |
| EP | 2083643 | A1 | 8/2009 |
| EP | 2201850 | A1 | 6/2010 |
| JP | 2010506594 | A | 3/2010 |
| WO | 2014201432 | | 12/2014 |
| WO | 2015091351 | | 6/2015 |

OTHER PUBLICATIONS

Minchang Liu, "Detection and characterization methods of the temperature distribution of cigarette", Zhengzhou Tobacco Research Institute of CNTC , Nov. 30, 2012, 79 pages.
International Search Report issued for PCT/CN2016/076087, dated Apr. 28, 2016, includes English translation, 17 pages.
Office Action issued in Chinese application No. 201510876100.5, with a Search Report, dated Aug. 14, 2017, total 7 pages.
Office Action issued in Japanese Patent Application No. 2017-503151 on Dec. 12, 2017, 5 pages.
The extended European search report issued in European application No. 16805712.3, dated Apr. 6, 2018, 8 pages.

* cited by examiner

CIGARETTE DISTILLATION AND ATOMIZATION DEVICE

BACKGROUND

Technical Field

The present invention relates to a cigarette distillation and atomization device.

Related Art

Cigarette is a strip-shaped smoking article made by using a cigarette paper to roll finely cut tobacco, and is also known as cigarette rolled in paper, tobacco cigarette, and roll of tobacco.

Currently, there are cigarettes with several lengths consisting of 84 mm, 100 mm, 90 mm, and 70 mm in a domestic cigarette market. With regard to the diameter, the diameter of most cigarettes produced by domestic cigarette manufacturers is 7.7 mm, and the diameter of imported cigarettes is 7.8 mm. An internationally popular cigarette specification refers to a length of 84 mm and a diameter of 7.8 mm, which is the optimal cigarette specification obtained through hundreds of years of smoker-based scientific experiments and calculations that are conducted in the world cigarette industry.

Smoke produced when a cigarette is burned and smoked can be divided into two parts including particles and gases, where matters that can be collected by a glass fiber filter or an electrostatic precipitation device are called a total particulate matter, and matters that cannot be collected are called gases. The weight of a main flow of smoke of each cigarette is about 500 mg, where 92% of the weight is occupied by a gas part consisting of about 58% of nitrogen, 12% of oxygen, 13% of carbon dioxide, 3.5% of carbon monoxide, 0.5% of hydrogen and argon, and 5% of vapor of water and low molecular organics, and about 8% is occupied by a particle part.

When a cigarette is burned and smoked, a great amount of chemical changes occur in an oxygen-deficiency and hydrogen-rich environment. When a cigarette is burned and smoked, a temperature distribution range can be generally classified into three areas:

(1) a high temperature area (600-900° C.), where combustion of organics generates an air flow caused by deficiency of oxygen, and carbon monoxide, carbon dioxide, hydrogen, and volatile hydrocarbons are mainly generated in this area;

(2) a pyrolysis, distillation, and atomization area (100-600° C.), where a hot air flow from the high temperature area enters this area and functions as energy to help the occurrence of reactions such as distillation and atomization, pyrolysis, and synthesis on various organics; most compounds are formed in this area; and these reactions are mainly endothermic reactions, causing a shape decline of a smoke temperature; and (3) a low temperature area (below 100° C.), where light gases in the smoke are diffused into air by passing through the cigarette paper, and the air infiltrates into the interior of the cigarette to dilute the air flow, and declining of the smoke temperature is continued until the smoke temperature is slightly higher than a room temperature.

It can be known that most harmful substances produced during combustion of a cigarette are produced during high temperature combustion, and other substances attracting smokers can be diffused when the temperature is relatively low.

SUMMARY

The present disclosure provides a cigarette distillation and atomization device, which may distil and atomize finely cut tobacco in a tobacco cigarette at a medium or low temperature, so as to diffuse fragrance of the finely cut tobacco and reduce production of harmful substances to the maximum extent, and provide a more healthy and environmentally friendly smoking manner for people that like smoking.

The present disclosure is implemented by using the technical means below.

A cigarette distillation and atomization device is provided, including: a support, an air inlet, and an air outlet, where the air inlet and the air outlet are provided on the support; a first heating system and a second heating system are provided in the support; the first heating system and the second heating system are hermetically connected; the first heating system includes a first cylinder; the second heating system includes a second cylinder; an inner cavity of the second cylinder is used to place a cigarette; the height of the second cylinder is 20 mm-64 mm, and the inner diameter of the second cylinder is equivalent to the outer diameter of the cigarette; air entering the air inlet is heated by the first heating system to form a hot air flow, and the hot air flow enters the second heating system; and the hot air flow and the second heating system simultaneously heat the cigarette placed in the second cylinder to form smoke, and the smoke goes out from the air outlet.

Further, the first heating system is provided below the second heating system; the air inlet is provided at a position, of the support, between the first heating system and the second heating system, and is hermetically connected to the first heating system; the air outlet is provided on a top cover; and the top cover is hermetically connected to the second heating system.

Further, the first heating system is provided below the second heating system; the air inlet is provided below the first heating system; the air outlet is provided on the top cover; and the top cover is hermetically connected to the second heating system.

Further, a heating temperature of the second heating system is 185° C.-230° C., and a heating temperature of the first heating system is 210° C.-255° C.

Further, the first heating system is provided with a first heating circuit; the second heating system is provided with a second heating circuit; a temperature sensor provided on a first cylinder outer layer is connected to the first heating circuit; a temperature sensor provided on an outer wall of the second cylinder is connected to the second heating circuit; the first heating circuit and the second heating circuit are connected to an intelligent control chip; when a temperature detected by the temperature sensor is greater than a set temperature upper limit, the intelligent control chip controls the first heating circuit or the second heating circuit to decrease a heating power; and when a temperature detected by the temperature sensor is less than a set temperature lower limit, the intelligent control chip controls the first heating circuit or the second heating circuit to increase a heating power.

Further, the second heating system is divided into an upper section and a lower section; each of the upper section and the lower section of the second heating system is connected to one of two heating subcircuits respectively; the two heating subcircuits together form the second heating circuit of the second heating system; a heating temperature of the lower section of the second heating system is 185° C.-210° C.; and a heating temperature of the upper section of the second heating system is 205° C.-230° C.

Further, a first filter sieve is provided between the air outlet and the second heating system; a second filter sieve is provided between the first heating system and the second heating system; and a heat insulation device is provided at the exterior of the first heating system and the second heating system.

Further, a spiral air guide column is provided in the first cylinder; and the spiral air guide column and the first cylinder are connected to a first heating circuit, so as to heat a gas passing through the spiral air guide column and the first cylinder.

Further, a material of the first cylinder or the second cylinder is a metal ceramics heater (MCH) or a metal, and a glaze layer is provided on an inner wall of the MCH.

At last, both of a base provided below the first heating system and a top cover provided above the second heating system are made of a polyether ether ketone (PEEK) material.

In the cigarette distillation and atomization device according to the above, a cigarette is diluted and atomized by an air flow of a medium or low temperature, so as to enable pectin, lignin, and flax cellulose in finely cut tobacco to be fully and effectively decomposed; and fragrance of the finely cut tobacco is diffused while 69 harmful substances in the cigarette may be reduced by more than 80% and total dust particles may be reduced by 90%, thereby protecting the health of people that like smoking in a better manner, protecting the environment, and encouraging a more healthy manner of cigarette smoking. In addition, after a cigarette is smoked, ash may not be produced, so as to avoid a current problem that ash is littered everywhere to damage the clean and tidy environment when a cigarette is smoked.

| | | | |
|---|---|---|---|
| 1 | support | 2 | air inlet |
| 31 | first cylinder outer layer | 32 | first cylinder inner layer |
| 33 | spiral air guide column | 4 | second cylinder |

-continued

| | | | |
|---|---|---|---|
| 5 | stainless steel layer | 61 | first heat-resistant silicone ring |
| 62 | second heat-resistant silicone ring | 63 | third heat-resistant silicone ring |
| 7 | spring | 8 | O-shaped ring |
| 91 | first temperature sensor | 92 | second temperature sensor |
| 10 | printed circuit board (PCB) | 11 | air outlet |
| 12 | cigarette accommodating area | 13 | top cover |
| 14 | first filter sieve | 15 | second filter sieve |
| 20 | air inlet | 30 | first cylinder |
| 40 | second cylinder | 41 | second cylinder lower section |
| 42 | second cylinder upper section | 9201 | second cylinder lower section sensor |
| 9202 | second cylinder upper section sensor | 301 | sensor of the first cylinder |
| 302 | spiral air guide column | | |

DETAILED DESCRIPTION

A specific implementation process of the present disclosure is described below in detail with reference to accompanying drawings.

Embodiment 1

Figure 1:
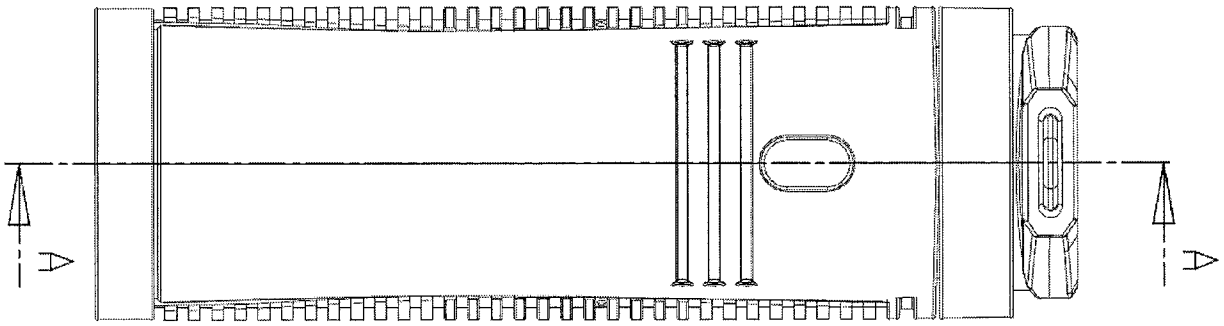
FIG. 1 is a schematic structural view of a cigarette distillation and atomization device according to a first embodiment of the present disclosure.
Figure 2:
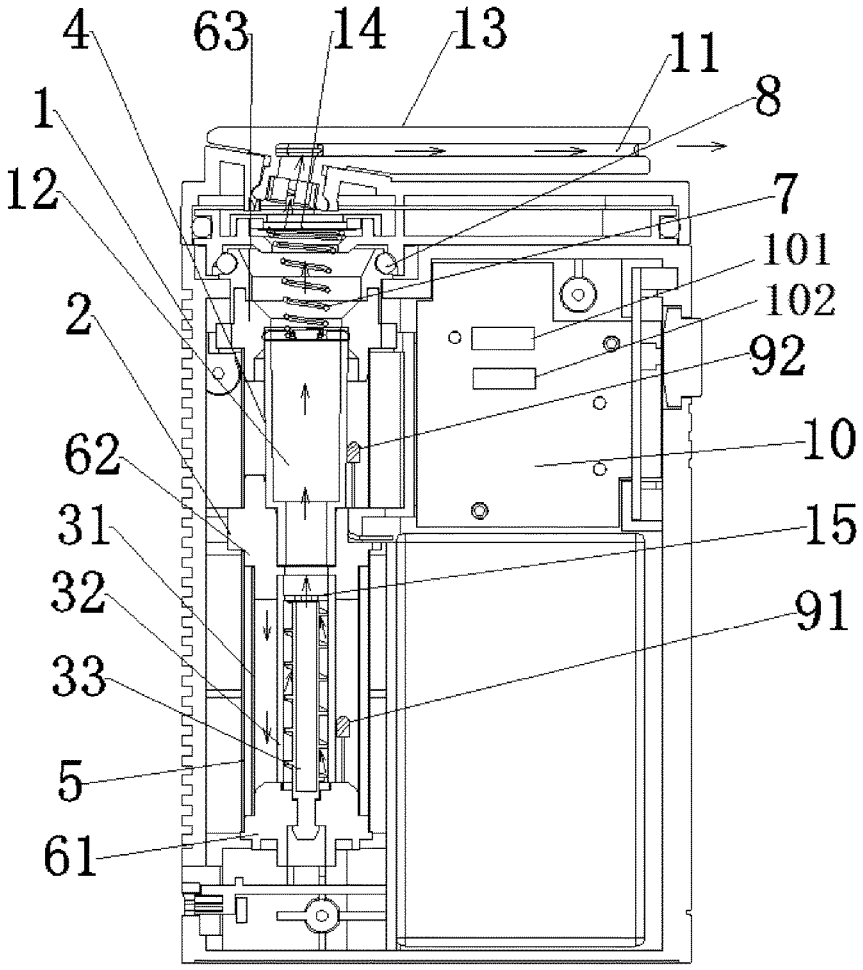
FIG. 2 is a sectional view of an A-A direction according to FIG. 1.

A cigarette distillation and atomization device is provided, as shown in FIG. 1 and FIG. 2, including: a support 1, an air inlet 2, and an air outlet 11, where the air inlet 2 and the air outlet 11 are provided on the support 1; a first heating system and a second heating system are provided in the support 1; the first heating system and the second heating system are hermetically connected; a cigarette accommodating area 12 is provided in the second heating system; air entering the air inlet is pre-heated by the first heating system to form a hot air flow, and the hot air flow enters the second heating system; and the hot air flow and the second heating system simultaneously heat, dilute, and atomize a cigarette placed in the cigarette accommodating area, so as to decompose and atomize finely cut tobacco to form smoke, and the smoke goes out from the air outlet. A direction of the air flow is as shown in a direction of an arrow in FIG. 2.

Specifically, the first heating system and the second heating system are provided at an upper position and a lower position separately; the first heating system is at the lower position, and the second heating system is at the upper position; and the first heating system and the second heating system are hermetically connected through a second heat-resistant silicone ring 62.

The first heating system is provided with a first cylinder; the first cylinder includes two layers including an inner layer and an outer layer, that is, a first cylinder inner layer 32 and a first cylinder outer layer 31; an air flow channel is provided between the first cylinder inner layer 32 and the first cylinder outer layer 31; a spiral air guide column 33 is further provided in the first cylinder inner layer 32; and the first cylinder outer layer 31, the first cylinder inner layer 32, and the spiral air guide column 33 are connected to a heating circuit, so as to heat air passing through the first cylinder outer layer 31, the first cylinder inner layer 32, and the spiral air guide column 33.

The air inlet 2 is provided at a position, of the support, between the first heating system and the second heating system, and the entire air inlet 2 is of an L tube shape. One end of the air inlet 2 penetrates through the second heat-resistant silicone ring 62 and is inserted between the first cylinder outer layer 31 and the first cylinder inner layer 32 of the first heating system, so as to introduce external air into the first heating system.

Specifically, as shown in FIG. 2, in order to increase the time for heating an air flow in the first heating system so as to enable the air flow to reach an ideal temperature, the air flow enters from one end (an upper end in the figure) of the first cylinder outer layer 31, and enters one end (a lower end in the figure) of the first cylinder inner layer 32 from the other end (a lower end in the figure) of the first cylinder outer layer 31, and then passes through the spiral air guide column 33 in the first cylinder inner layer 32. The spiral air guide column 33 is formed by arranging a spiral guide vane on an outer wall of a cylinder; the air flow flows from one end (the lower end in the figure) of the first cylinder inner layer 32 to the other end (the upper end in the figure) along the spiral guide vane, so as to further prolong the time for heating the air flow in the first heating system and enable the air to be sufficiently heated to achieve an ideal temperature; and then the air flow enters the second heating system through the air flow channel between the first heating system and the second heating system, where the air flow channel is a center hole provided on the second heat-resistant silicone ring 62.

As shown in FIG. 2, the second heating system is provided with a second cylinder 4; inner space of the second cylinder 4 is a cigarette accommodating area 12; the inner diameter of the second cylinder 4 is equivalent to the outer diameter of a cigarette, and the height is 20 mm-30 mm and is equivalent to the length of a half of the cigarette. An upper part of the second cylinder 4 is connected to the air outlet 11, and a lower part is hermetically connected to the first heating system.

The air outlet 11 is provided on a top cover 13, and the top cover 13 and the second heating system are hermetically connected through an O-shaped ring 8. To prevent a cigarette placed in the cigarette accommodating area 12 from shaking in the cigarette accommodating area, a spring 7 is provided below the top cover 13; the other end of the spring 7 enters the cigarette accommodating area 12; and when the cigarette is place in the cigarette accommodating area 12, the cigarette closely adheres to the second cylinder 4 under an effect of the spring 7.

To make the first heating system and the second heating system have good thermal conductivity and electrical conductivity, the second cylinder 4, the first cylinder inner layer 32, and the first cylinder outer layer 31 are separately MCHs or conductive metals; a first temperature sensor 91 is provided on a first cylinder outer layer 31 of the first heating system, and likewise, a second temperature sensor 92 is provided on an outer wall of the second cylinder 4 of the second heating system; the temperature sensor 91 and the temperature sensor 92 are connected to a first heating circuit 101 of the first heating system and a second heating circuit 102 of the second heating system, respectively; the first heating circuit 101 and the second heating circuit 102 are provided on a printed circuit board (PCB) 10; and the PCB 10 is connected to an intelligent control chip.

To make a cigarette be sufficiently diluted and atomized to diffuse fragrance and produce minimum harmful substances, a heating temperature of the second heating system is controlled to be 180° C.-200° C., and a heating temperature of the first heating system is 260° C.-300° C. When a temperature detected by the first temperature sensor 91 is greater than a set upper limit of 300° C., the intelligent control chip controls the first heating circuit 101 to decrease a heating power; and when a temperature detected by the first temperature sensor 91 is less than a set temperature of 260° C., the intelligent control chip controls the first heating circuit 101 to increase a heating power. Likewise, when a temperature detected by the temperature sensor 92 of the second heating system is less than a set lower limit of 180° C., the intelligent control chip controls the second heating circuit 102 to increase a heating power; and when a temperature detected by the temperature sensor 92 of the second heating system exceeds a set upper limit of 200° C., the intelligent control chip controls the second heating circuit 102 to decrease a heating power.

To prevent finely cut tobacco of a cigarette from being inhaled into a mouth, a first filter sieve 14 is provided between the air outlet 11 and the second heating system. To prevent finely cut tobacco from falling into the first heating system, a second filter sieve 15 is provided between the first heating system and the second heating system.

To prevent a user from being burned by a high temperature and prevent the support from being scorched, heat insulation devices are provided at the exteriors of the first heating system and the second heating system. The heat insulation devices are heat-resistant silicone provided at the exteriors of the first heating system and the second heating system, that is, a first heat-resistant silicone ring 61, the second heat-resistant silicone ring 62, and a third heat-resistant silicone ring 63 in the figure, and the heat-resistant silicone rings has a sealing function as well as a fastening function. The heat insulation device may be also a vacuum layer provided on the first heating system or the second heating system; the vacuum layer is a circle of stainless steel layer provided outside an outer wall of the first heating system or the second heating system; and space between the stainless steel layer and the outer wall of the first heating system or the second heating system is provided as vacuum space. The heat-resistant silicone rings and the vacuum layers may be used in combination or separately. In this embodiment, heat-resistant silicone rings are provided at the exteriors of the first heating system and the second heating system, and a vacuum layer is further provided outside the first cylinder outer layer of the first heating system, that is, a circle of stainless steel layer 5 is provided outside the first cylinder outer layer of the first heating system, and air between the stainless steel layer 5 and the first cylinder outer layer 31 is evacuated to form a vacuum layer, thereby further improving a heat insulation effect.

Figure 3:
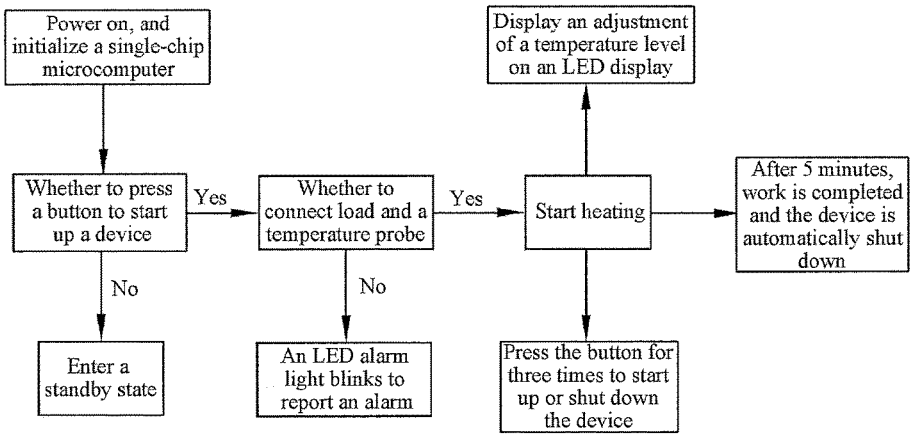
FIG. 3 is a schematic diagram of a control circuit according to the present disclosure.

The intelligent control chip is further connected to a light emitting diode (LED) display, a switch, and an LED alarm light as shown in FIG. 3, so as to enable the cigarette distillation and atomization device to be more intelligent and human-centered on the whole, for example, information such as a heating temperature of a cigarette, the heating time of the cigarette, and battery power may be displayed through an LED display; with the arrangement of an LED alarm light, in a case in which a heating temperature obviously exceeds a set range or battery power is low, an alarm signal is sent to a user; and a user can control a usage state and a resting state of the cigarette distillation and atomization device in a better manner through a switch.

In the cigarette distillation and atomization device according to the above, a cigarette may be placed in the cigarette accommodating area, and a cigarette is diluted and atomized by an air flow of a medium or low temperature, so as to enable pectin, lignin, and flax cellulose in finely cut tobacco to be fully and effectively decomposed; and fragrance of the finely cut tobacco is diffused while 69 harmful substances in the cigarette may be reduced by more than 80% and total dust particles may be reduced by 90%, thereby protecting the health of people that like smoking in a better manner, protecting the environment, and encouraging a more healthy manner of cigarette smoking. In addition, after a cigarette is smoked, ash may not be produced, so as to avoid a current problem that ash is littered everywhere to damage the clean and tidy environment when a cigarette is smoked.

Embodiment 2

Figure 4:
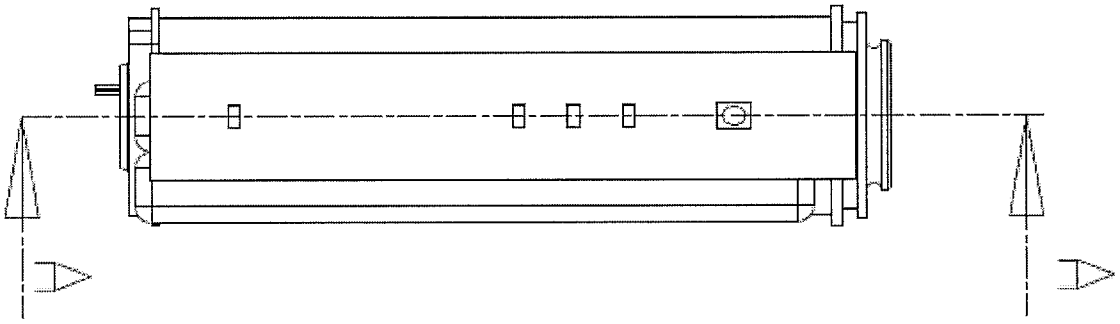
FIG. 4 is a schematic structural view of a cigarette distillation and atomization device according to a second embodiment of the present disclosure.
Figure 5:
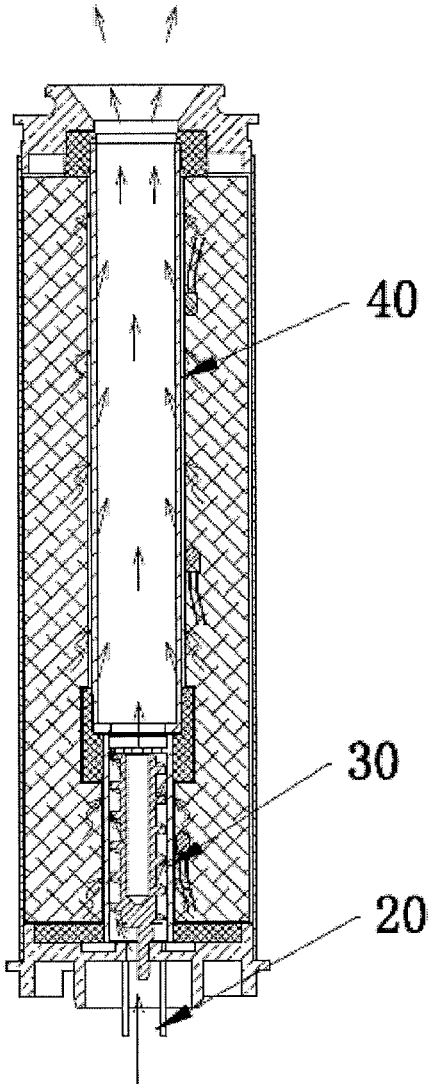
FIG. 5 is a sectional view of an A-A direction according to FIG. 4.
Figure 6:
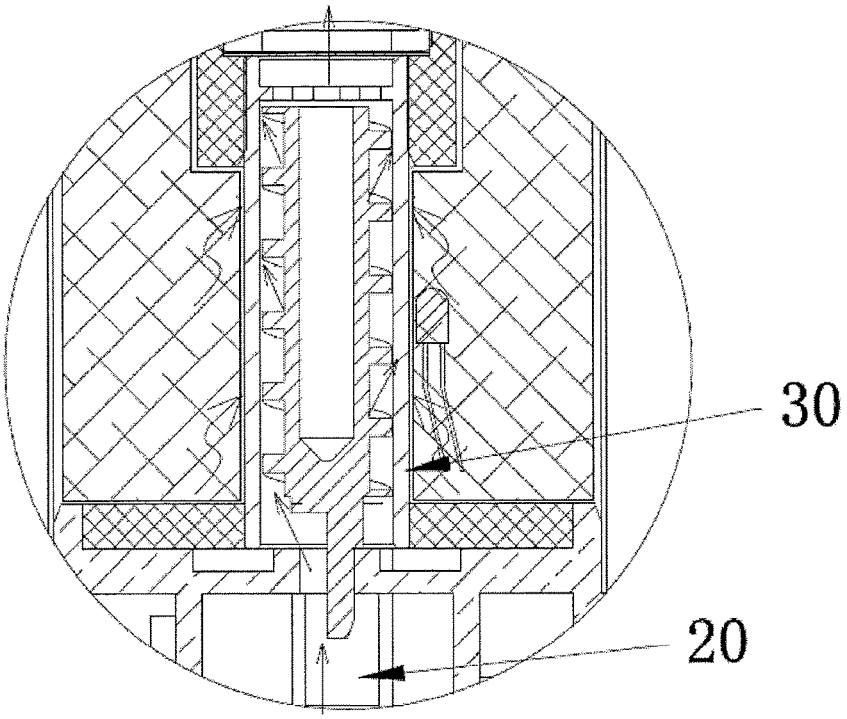
FIG. 6 is a locally enlarged schematic view of the sectional diagram according to FIG. 5 of the present disclosure.

As shown in FIG. 4, FIG. 5, and FIG. 6, a cigarette distillation and atomization device is provided, where an air inlet 20 thereof is provided at the bottom of the device, and a manner for arranging an air outlet is the same as that in Embodiment 1. A first heating system and a second heating system are provided in the support; the first heating system and the second heating system are hermetically connected; the first heating system includes a first cylinder 30; the second heating system includes a second cylinder 40; the first heating system is provided with a first heating circuit 101 used to preheat cold air that enters the first heating system; and the second heating system is provided with a second heating circuit 102 used to dilute, bake, and atomize a cigarette placed in the second heating system.

The height of the second cylinder is 40 mm-64 mm, the inner diameter of the second cylinder is equivalent to the outer diameter of a cigarette, and a cigarette with a standard length may be placed in the second cylinder. Air entering the air inlet is preheated by the first heating system to form a hot air flow, and the hot air flow enters the second heating system; and the hot air flow and the second heating system simultaneously heat the cigarette placed in the second cylinder to form smoke, and the smoke goes out from the air outlet. A direction of the air flow is as shown in a direction of an arrow in FIG. 5.

Figure 7:
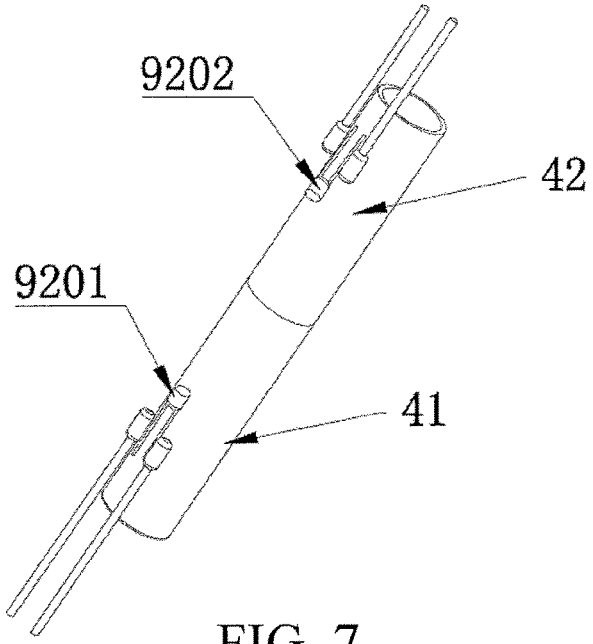
FIG. 7 is a schematic partial view of a second heating system according to the second embodiment of the present disclosure.

The second heating system is divided into an upper section and a lower section, as shown in FIG. 7, a second cylinder lower section 41 and a second cylinder upper section 42, and a second cylinder lower section sensor 9201 provided on an outer wall of the second cylinder lower section 41 and a second cylinder upper section sensor 9202 provided on an outer wall of the second cylinder upper section 42. A material of the first cylinder or the second cylinder is an MCH or a metal, and a glaze layer is provided on an inner wall of the MCH, and therefore, a cigarette provided in the second cylinder would not be easily adhered. The second cylinder performs heating by using second heating circuit 102, so as to enable a heating temperature of the second cylinder to be 185° C.-230° C.

Further, the second heating circuit 102 is divided into two subcircuits that are configured to separately control a heating temperature of the second cylinder upper section and a heating temperature of the second cylinder lower section. The heating temperature of the second cylinder upper section is 205° C.-230° C., and the heating temperature of the second cylinder lower section is 185° C.-210° C.

Figure 8:
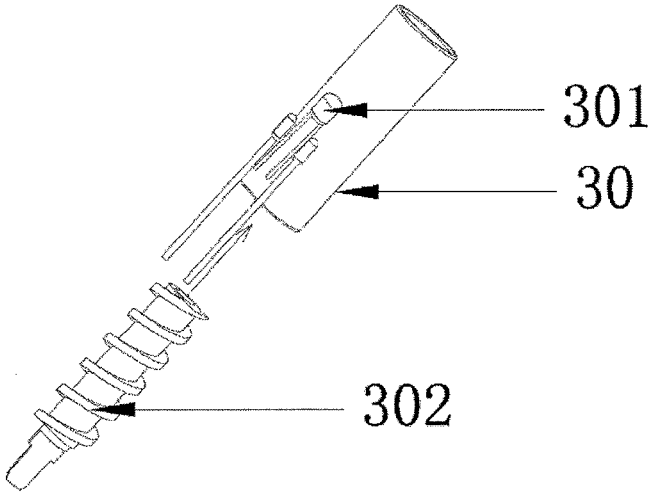
FIG. 8 is a schematic partial view of a first heating system according to the second embodiment of the present disclosure.

As shown in FIG. 8, the first heating system includes a first cylinder 30; the first cylinder 30 is an annular metal cylinder; a first cylinder temperature sensor 301 is provided on an outer wall of the first cylinder 30; a spiral air guide column 302 is provided in the first cylinder 30; the spiral air guide column and the first cylinder are connected to first heating circuit 101, so as to heat air passing through the spiral air guide column and the first cylinder; and the first cylinder temperature sensor 301 is configured to detect the heating temperature of the first cylinder 30.

The temperature sensor provided on an outer wall of the second cylinder includes a second cylinder upper section sensor 9202 and a second cylinder lower section sensor 9201, separately connected to the two heating subcircuits of the second heating circuit 102. Likewise, a temperature sensor is also provided on an outer wall of the first cylinder, and the temperature sensor is connected to the first heating circuit 101. The first heating circuit 101 and the second heating circuit 102 are connected to an intelligent control chip. When a temperature detected by the temperature sensor is greater than a set temperature upper limit, the intelligent control chip controls the first heating circuit 101 or the second heating circuit 102 to decrease a heating power; and when a temperature detected by the temperature sensor is less than a set temperature lower limit, the intelligent control chip controls the first heating circuit 101 or the second heating circuit 102 to increase a heating power.

Both of a base provided below the first heating system and a top cover provided above the second heating system are made of a polyether ether ketone (PEEK) material. The base is made of a PEEK material, and is beautiful and high temperature resistant.

Aside from manners of arranging the air inlet at the middle or the bottom in the embodiment of the present disclosure, there is a plurality of other arrangement manners, which are not illustrated one by one herein.

Other structures and functions of the structures are the same as those in the first embodiment, and are not described herein again.

In the cigarette distillation and atomization device according to the above, a cigarette can be placed in a cigarette accommodating area formed in the second cylinder, and temperatures for diluting and atomizing an upper section and a lower section of the cigarette are different, so as to sufficiently diffuse the fragrance of the cigarette on the whole and avoid the production of harmful substances as far as possible.

The above referred accompany drawings illustrate exemplary embodiments of the present disclosure, but do not intent to limit the scope of the claims of the present disclosure. Any variations, equivalent replacements, and improvements made by a person skilled in the art without departing from the scope and essence of the present disclosure shall fall within the scope of the claims of the present disclosure.

What is claimed is:

1. A cigarette distillation and atomization device, comprising: a support, an air inlet, and an air outlet, wherein the air inlet and the air outlet are provided on the support; a first heating system and a second heating system are provided in the support; the first heating system and the second heating system are hermetically connected; the first heating system comprises a first cylinder; the second heating system comprises a second cylinder; an inner cavity of the second cylinder is used to place a cigarette; a height of the second cylinder is 20 mm-64 mm, and an inner diameter of the second cylinder is equivalent to an outer diameter of the cigarette; the first heating system is provided with a first heating circuit used to preheat cold air that enters the first heating system, the second heating system is provided with a second heating circuit used to dilute, bake, and atomize the cigarette when the cigarette placed in the second heating system; air entering the air inlet is heated by the first heating system to form a hot air flow, and the hot air flow enters the second heating system; and the hot air flow and the second heating system simultaneously heat the cigarette placed in the second cylinder to form smoke, and the smoke goes out from the air outlet.

2. The cigarette distillation and atomization device according to claim 1, wherein the first heating system is provided below the second heating system; the air inlet is provided at a position, of the support, between the first heating system and the second heating system, and is hermetically connected to the first heating system; the air outlet is provided on a top cover; and the top cover is hermetically connected to the second heating system.

3. The cigarette distillation and atomization device according to claim 1, wherein the first heating system is provided below the second heating system; the air inlet is provided below the first heating system; the air outlet is provided on a top cover; and the top cover is hermetically connected to the second heating system.

4. The cigarette distillation and atomization device according to claim 2, wherein a heating temperature of the second heating system is 185° C.-230° C., and a heating temperature of the first heating system is 210° C.-255° C.

5. The cigarette distillation and atomization device according to claim 3, wherein a heating temperature of the second heating system is 185° C.-230° C., and a heating temperature of the first heating system is 210° C.-255° C.

6. The cigarette distillation and atomization device according to claim 1, wherein a temperature sensor provided on an outer wall of the first cylinder is connected to the first heating circuit; a temperature sensor provided on an outer wall of the second cylinder is connected to the second heating circuit; the first heating circuit and the second heating circuit are connected to an intelligent control chip; when a temperature detected by the temperature sensor is greater than a set temperature upper limit, the intelligent control chip controls the first heating circuit or the second heating circuit to decrease a heating power; and when a temperature detected by the temperature sensor is less than a set temperature lower limit, the intelligent control chip controls the first heating circuit or the second heating circuit to increase a heating power.

7. The cigarette distillation and atomization device according to claim 6, wherein the second heating system is divided into an upper section and a lower section; a heating temperature of the lower section of the second heating system is 185° C.-210° C.; and a heating temperature of the upper section of the second heating system is 205° C.-230° C.

8. The cigarette distillation and atomization device according to claim 1, wherein a first filter sieve is provided between the air outlet and the second heating system; a second filter sieve is provided between the first heating system and the second heating system; and heat insulation devices are provided at the exteriors of the first heating system and the second heating system.

9. The cigarette distillation and atomization device according to claim 1, wherein a spiral air guide column is provided in the first cylinder; and the spiral air guide column and the first cylinder are connected to a first heating circuit, so as to heat air passing through the spiral air guide column and the first cylinder.

10. The cigarette distillation and atomization device according to claim 1, wherein a material of the first cylinder or the second cylinder is selected from a group consisting of a metal ceramics heater (MCH) and a metal, and a glaze layer is provided on an inner wall of the MCH.

11. The cigarette distillation and atomization device according to claim 1, wherein both of a base provided below the first heating system and a top cover provided above the second heating system are made of a polyether ether ketone (PEEK) material.

* * * * *